US008210454B2

(12) United States Patent
Frasch et al.

(10) Patent No.: US 8,210,454 B2
(45) Date of Patent: Jul. 3, 2012

(54) FUEL INJECTOR WITH PISTON RESTORING OF A PRESSURE INTENSIFIER PISTON

(75) Inventors: Juergen Frasch, Holzgerlingen (DE); Stephan Wehr, Heilgenstadt (DE)

(73) Assignee: Robert Bosch GmbH, Stuttgart (DE)

( * ) Notice: Subject to any disclaimer, the term of this patent is extended or adjusted under 35 U.S.C. 154(b) by 538 days.

(21) Appl. No.: 12/377,906

(22) PCT Filed: Jul. 6, 2007

(86) PCT No.: PCT/EP2007/056865

§ 371 (c)(1),
(2), (4) Date: Feb. 18, 2009

(87) PCT Pub. No.: WO2008/019910

PCT Pub. Date: Feb. 21, 2008

(65) Prior Publication Data

US 2011/0168812 A1 Jul. 14, 2011

(30) Foreign Application Priority Data

Aug. 18, 2006 (DE) ..... 10 2006 038 840

(51) Int. Cl.
*F02M 63/00* (2006.01)

(52) U.S. Cl. .... 239/533.3; 239/96; 239/124; 239/533.1; 239/533.5; 239/533.15; 303/114.1

(58) Field of Classification Search ..... 239/96, 239/124, 533.1, 533.4, 533.5, 533.12, 533.13, 239/533.15, 533.9, 569, 571, 570, 572; 303/114.1
See application file for complete search history.

(56) References Cited

U.S. PATENT DOCUMENTS 2,297,399 A 9/1942 Fuscaldo
4,579,283 A * 4/1986 Igashira et al. ..... 239/88
4,603,918 A * 8/1986 Leiber et al. ..... 303/9.75
5,988,768 A * 11/1999 Schaefer et al. ..... 303/114.1

(Continued)

FOREIGN PATENT DOCUMENTS

DE 1018635 A1 11/2002

(Continued)

*Primary Examiner* — Dinh Q Nguyem
*Assistant Examiner* — Trevor E McGraw
(74) *Attorney, Agent, or Firm* — Ronald E. Greigg

(57) ABSTRACT

The invention relates to a fuel injector for injecting fuel into a combustion chamber of an internal combustion engine, which fuel injector comprises an injection valve element, for opening and closing at least one injection opening and a pressure booster, by way of which fuel which is at system pressure is compressed to injection pressure. The pressure booster is actuated via a first control valve and the injection valve element is actuated via a second control valve. The pressure booster comprises a pressure booster piston which is assigned a spring element which is supported by way of one side on the injector housing and by way of the other side on the pressure booster piston. The pressure booster piston delimits a compression chamber, a differential pressure chamber and a control chamber. The control chamber is arranged at that end of the pressure booster piston which lies opposite the compression chamber, the spring element is received in the control chamber, and the spring element is supported on one side on the injector housing and on the other side on the pressure booster piston.

20 Claims, 3 Drawing Sheets

U.S. PATENT DOCUMENTS

| | | | | |
|---|---|---|---|---|
| 6,007,160 | A * | 12/1999 | Lubbers et al. | 303/114.1 |
| 6,135,575 | A * | 10/2000 | Feigel et al. | 303/113.4 |
| 6,183,049 | B1 * | 2/2001 | Oka et al. | 303/114.1 |
| 6,644,282 | B2 * | 11/2003 | Schwarz | 123/467 |
| 6,935,705 | B2 * | 8/2005 | Simon Bacardit et al. | 303/114.1 |
| 2002/0060110 | A1 * | 5/2002 | Gotoh | 188/322.13 |
| 2002/0088435 | A1 * | 7/2002 | Kropp et al. | 123/446 |
| 2003/0155444 | A1 | 8/2003 | Lawes | |
| 2004/0025843 | A1 * | 2/2004 | Magel | 123/446 |
| 2004/0025845 | A1 * | 2/2004 | Magel | 123/447 |
| 2005/0224599 | A1 | 10/2005 | Magel | |
| 2006/0243252 | A1 * | 11/2006 | Eisenmenger et al. | 123/447 |

FOREIGN PATENT DOCUMENTS

| | | | |
|---|---|---|---|
| DE | 102004005451 | A1 | 8/2005 |
| EP | 1584814 | A1 | 10/2005 |
| WO | 2004088122 | A1 | 10/2004 |
| WO | WO2004088122 | * | 10/2004 |

* cited by examiner

FUEL INJECTOR WITH PISTON RESTORING OF A PRESSURE INTENSIFIER PISTON

CROSS-REFERENCE TO RELATED APPLICATION

[0000.4] This application is a 35 USC 371 application of PCT/EP 2007/056865 filed Jul. 6, 2007.

BACKGROUND OF THE INVENTION

1. Field of the Invention

The invention is based on a fuel injector for injecting fuel into a combustion chamber of an internal combustion engine.

2. Description of the Prior Art

DE-A 103 35 340 has disclosed a fuel injector that includes a control valve for a pressure booster. The pressure booster has a working chamber that is separated from a differential pressure chamber by a pressure booster piston. The pressure change in the differential pressure chamber of the pressure booster is carried out by means of a servo valve that is activated by an associated switching valve. The differential pressure chamber contains a spring element that encompasses a lower section of the pressure booster piston, which has a diameter that is smaller than the upper section of the pressure booster piston. One end of the spring element is supported on the upper section of the pressure booster piston and the other end is supported on the injector housing. The spring element produces a restoring movement of the pressure booster piston. The disadvantage of this design is that it is not possible to pre-assemble the pressure booster piston and spring element. In addition, this embodiment has spatial disadvantages since it is necessary to select the outer diameter of the spring element to be smaller than the large piston diameter.

SUMMARY OF THE INVENTION

A fuel injector embodied according the invention, which is for injecting fuel into a combustion chamber of an internal combustion engine, includes an injection valve element for opening and closing at least one injection opening and a pressure booster with which fuel at system pressure is compressed to injection pressure. A first control valve triggers the pressure booster and a second control valve triggers the injection valve element; the pressure booster includes a pressure booster piston that is associated with a spring element whose one end is supported on the injector housing and whose other end is supported on the pressure booster piston. The pressure booster piston delimits a compression chamber, a differential pressure chamber, and a control chamber; the control chamber is situated at the end of the pressure booster piston opposite from the compression chamber and the spring element is contained in the control chamber; one end of the spring element is supported on the injector housing and the other is supported on the pressure booster piston.

The spring element is preferably a spiral spring embodied in the form of a compression spring, which tapers conically at the end with which it is supported on the pressure booster piston. The conical tapering at the end with which the spring element is supported on the pressure booster piston prevents the spring element from rubbing against the upper section of the pressure booster piston that it encompasses and thereby contributing to the wear of the pressure booster piston and the spring element.

In order to be able to produce the pressure booster piston in a single piece, a spring plate against which the spring element rests is mounted on the pressure booster piston. The spring plate preferably rests against a ring element that is accommodated in a groove in the pressure booster piston. Preferably, the spring plate has a cylindrical shoulder that encompasses the ring element. The spring plate makes it possible to carry out the installation first by sliding the spring element onto the upper section of the pressure booster piston and then mounting the spring plate on the upper section of the pressure booster piston. The mounting of the spring plate preferably occurs by means of the ring element that is accommodated in the groove in the pressure booster piston. The ring element is preferably a snap ring. In order to install the snap ring on the upper section of the pressure booster piston, preferably a bevel is provided on the piston, which allows the snap ring to be slid on. The snap ring is slid onto the upper section of the pressure booster piston until it snaps into the groove. Then the spring plate is pressed against the ring element with the aid of the spring element so that the cylindrical section slides on around the ring element. This achieves a stable seating of the spring plate.

In a preferred embodiment, the end of the spring element opposite from the spring plate is supported on a ring, which rests against a shoulder on the injector housing. The ring has an inner diameter that is larger than the diameter of the upper section of the pressure booster piston and smaller than the diameter of its middle section. The ring makes it possible to pre-assemble the pressure booster piston and the spring element, with the spring element in a prestressed position. To this end, the ring is first slid onto the upper section of the pressure booster piston until it comes to rest against the middle section. Then the spring element is slid onto the upper section of the pressure booster piston. In a subsequent step, the spring plate is placed onto the upper section of the pressure booster piston. The spring element together with the spring plate is prestressed and the ring element is slid onto the upper section of the pressure booster piston until it snaps into the groove. In this way, one end of the prestressed spring element is supported against the ring that rests against the middle section and the other end is supported against the spring plate.

The pressure booster piston is preferably embodied of one piece and includes an upper section that is produced with a first diameter, a middle section that is produced with a second diameter, and a lower section that is produced with a third diameter. The second diameter in which the middle section is produced is larger than both the first diameter of the upper section and the third diameter of the lower section. In a completely assembled fuel injector, the upper section is encompassed by the control chamber, the middle section delimits the control chamber with a first shoulder and delimits the differential pressure chamber with a second shoulder situated at the opposite end from the first shoulder, while the lower section delimits the compression chamber.

To enable actuation of the fuel injector, the control chamber is hydraulically connected to the compression chamber; the connection contains a check valve that prevents a reverse flow of fuel from the compression chamber back into the control chamber. In a preferred embodiment, the hydraulic connection of the control chamber to the compression chamber is embodied in the form of a bore in the pressure booster piston.

To enable actuation of the fuel injector, the first control valve is able to connect the differential pressure chamber to a fuel supply or a fuel return. To this end, the first control valve is embodied in the form of a 3/2-way directional-control valve.

BRIEF DESCRIPTION OF THE DRAWINGS

Exemplary embodiments of the invention will be explained in greater detail in the subsequent description in conjunction with the drawings, in which.

DESCRIPTION OF THE PREFERRED EMBODIMENT

Figure 1:
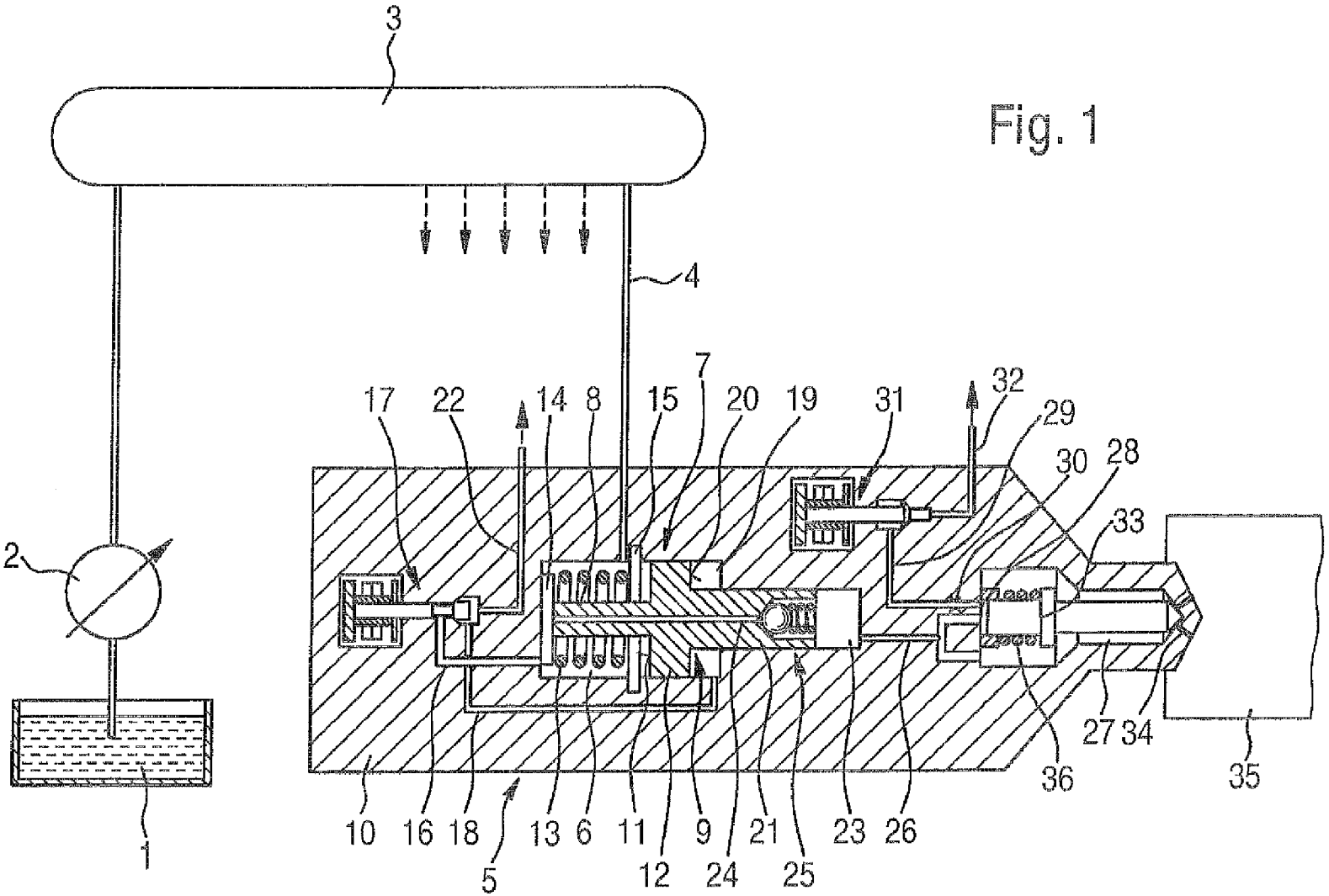
FIG. 1 is a hydraulic diagram of a fuel injector embodied according to the invention.

FIG. 1 is a hydraulic diagram of a fuel injector embodied according to the invention.

A pump 2 draws fuel from a fuel storage tank 1 and supplies its to a high-pressure reservoir 3. From the high-pressure reservoir 3, the fuel is supplied to a fuel injector 5 via a fuel supply line 4. To this end, the fuel supply line 4 feeds into a control chamber 6 of a pressure booster 7. The control chamber 6 encompasses an upper section 8 of a pressure booster piston 9. The control chamber 6 is delimited at one end by the injector housing 10 and that the other end by a first shoulder 11 of a middle section 12 of the pressure booster piston 9.

Also according to the invention, the control chamber 6 contains a spring element 13 that encompasses the upper section 8 of the pressure booster piston 9. One end of the spring element 13 is supported against a spring plate 14 in the upper section 8 of the pressure booster piston 9 and the other end is supported against a ring 15. The ring 15 here is held by the injector housing 10. The spring element 13 is preferably a spiral spring embodied in the form of a compression spring.

A supply line 16 connects the control chamber 6 to a first control valve 17. The first control valve 17 is a 3/2-way directional-control valve. The first control valve 17 is actuated by means of an electrically triggerable actuator. This can, for example, be an electromagnetic or piezoelectric actuator. Any other rapidly switching actuating unit known to those skilled in the art can also be used as the actuator.

In a first switched position of the first control valve 17, the control chamber 6 is connected to a differential pressure chamber 19 via the supply line 16 and a conduit 18. The differential pressure chamber 19 is delimited by a second shoulder 20 of the middle section 12 of the pressure booster piston 9. The second shoulder 20 here is situated at the opposite end from the first shoulder 11. In addition, the differential pressure chamber 19 encompasses a lower section 21 of the pressure booster piston 9.

In a second switched position of the first control valve 17, the differential pressure chamber 19 is connected to a fuel return 22 via the conduit 18. The fuel return 22 preferably feeds into the fuel storage tank 1.

The lower section 21 of the pressure booster piston 9 delimits a compression chamber 23. A conduit 24, which is embodied for example in the form of a bore in the pressure booster piston 9, fills the compression chamber 23 with fuel. A check valve 25 is provided in the conduit 24 to prevent fuel from flowing out of the compression chamber 23 via the conduit 24 and back into the control chamber 6.

From the compression chamber 23, fuel at injection pressure is supplied via a high-pressure line 26 into a nozzle chamber 27 and a second control chamber 28. The fuel travels out of the second control chamber 28 to a second control valve 31 via an outlet line 29 that contains an outlet throttle 30. The second control valve 31 is embodied as a 2/2-way directional-control valve that can open or close a connection from the outlet line 29 into a fuel return 32. The second fuel return 32 is connected, for example, to the fuel return 22 or directly to the fuel storage tank 1. The second control valve 31 is usually actuated with an electrically triggered actuator. The actuator can, for example, be a solenoid valve or a piezoelectric actuator. As in the first control valve 17, any other rapidly switching actuating unit known to those skilled in the art can also be used.

An injection valve element 33 extends into the second control chamber 28. The injection valve element 33 is able to open or close at least one injection opening 34. When the injection opening 34 is open, fuel flows out of the nozzle chamber 27 through the injection opening 34 and into a combustion chamber 35 of an internal combustion engine.

In order to initiate the injection event, the first control valve 17 is initially switched so that the connection from the differential pressure chamber 19 via the conduit 18 into the fuel return 22 is open. As a result, the pressure in the differential pressure chamber 19 drops. In addition, system pressure continues to prevail in the control chamber 6. For this reason, the force of pressure acting on the first shoulder 11 on the middle section 12 is greater than the force acting on the second shoulder 20 and the lower section 21 of the pressure booster piston 9. The pressure booster piston 9 is slid into the compression chamber 23. As a result, the fuel contained in the compression chamber 23 is compressed to injection pressure. The compressed fuel flows through the high-pressure line 26 into the nozzle chamber 27 and second control chamber 28. So that the injection valve element 33 can lift away from its seat and thus open the at least one injection opening 34, the second control valve 31 is switched so that the connection from the outlet line 29 into the fuel return 32 is open. As a result, the fuel flows out of the second control chamber 28. The pressure in the second control chamber 28 decreases and the fuel at injection pressure acts on the injection valve element 33 so that it is lifted away from its seat. Fuel is injected into the combustion chamber 35 of the internal combustion engine.

In order to terminate the injection event, the second control valve 31 is initially switched so that the connection from the outlet line 29 to the fuel return 32 is closed. As a result, the pressure in the second control chamber 28 rises to injection pressure. The injection valve element is moved into its seat, thus closing the at least one injection opening 34. A spring element 36 assists the movement of the injection valve element 33. The second spring element 36 is preferably a spiral spring embodied in the form of a compression spring, one end of which is supported against a shoulder on the injection valve element 33 and the other end of which is supported against the injector housing 10. The second spring element 36 is embodied so that it assists the movement of the injection valve element 33 into its seat. Next, the first control valve 17 is switched so that the connection from the control chamber 6 to the differential pressure chamber 19 via the supply line 16 and the conduit 18 is open. As a result, fuel at system pressure flows out of the control chamber 6 into the differential pressure chamber 19. System pressure builds up in the differential pressure chamber 19. Assisted by the spring element 13, the pressure booster piston 9 is moved into its starting position. In other words, the booster piston 9 is moved into the first control chamber 6. At the same time, this also increases the volume of the compression chamber 23. The pressure in the compression chamber 23 decreases. As soon as the pressure in the compression chamber 23 has fallen below the system pressure, the check valve 25 opens and fuel flows out of the control chamber 6 into the compression chamber 23 via the conduit 24 in the pressure booster piston 9. As soon as the pressure booster piston 9 has reached its starting position, i.e. the position of the pressure booster piston 9 in which the volume in the compression chamber 23 has reached its maximum, the next injection event can begin.

Figure 2:
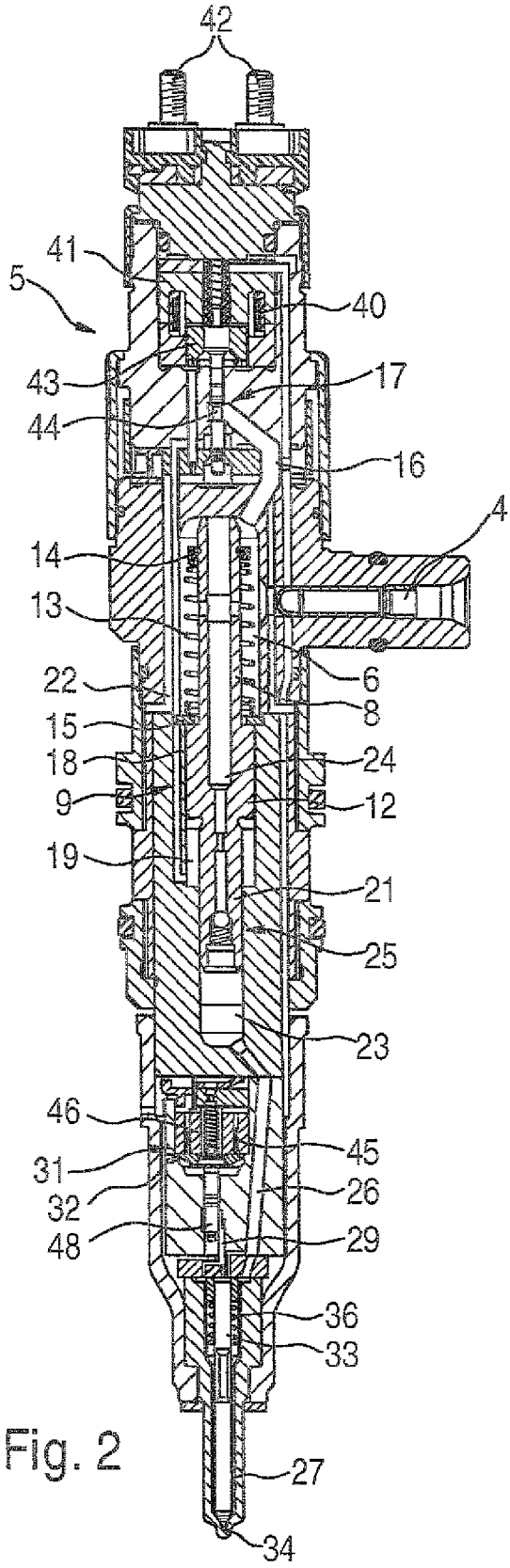
FIG. 2 is a sectional view of a fuel injector embodied according to the invention.

FIG. 2 gives a more detailed view of a fuel injector embodied according to the invention.

FIG. 2 shows that the first control valve 17 is embodied in the form of a solenoid valve. In this case, the first control valve 17 has a coil 40 that is contained in a magnet core 41. To trigger the first control valve 17, the coil 40 can be connected to a control unit that is not shown here via connecting pins 42. The first control valve 17 also has an armature 43 that is connected to a valve slider 44. By means of the valve slider 44, the first control valve 17 can be switched so that either the supply line 16 from the control chamber 6 is connected to the conduit 18 into the differential pressure chamber 19 or this connection is closed and a connection of the conduit 18 from the differential pressure chamber 19 to the fuel return 22 is open instead.

The second control valve 31 shown in FIG. 2 is also embodied in the form of a solenoid valve. In this case, the second control valve 31 has a second coil 45 that is contained in a second magnet core 46. The second control valve 31 also has a second armature 47 that is connected to a valve element 48. The second valve element 48 can close or open a connection from the outlet line 29 into the fuel return 32.

Figure 3:
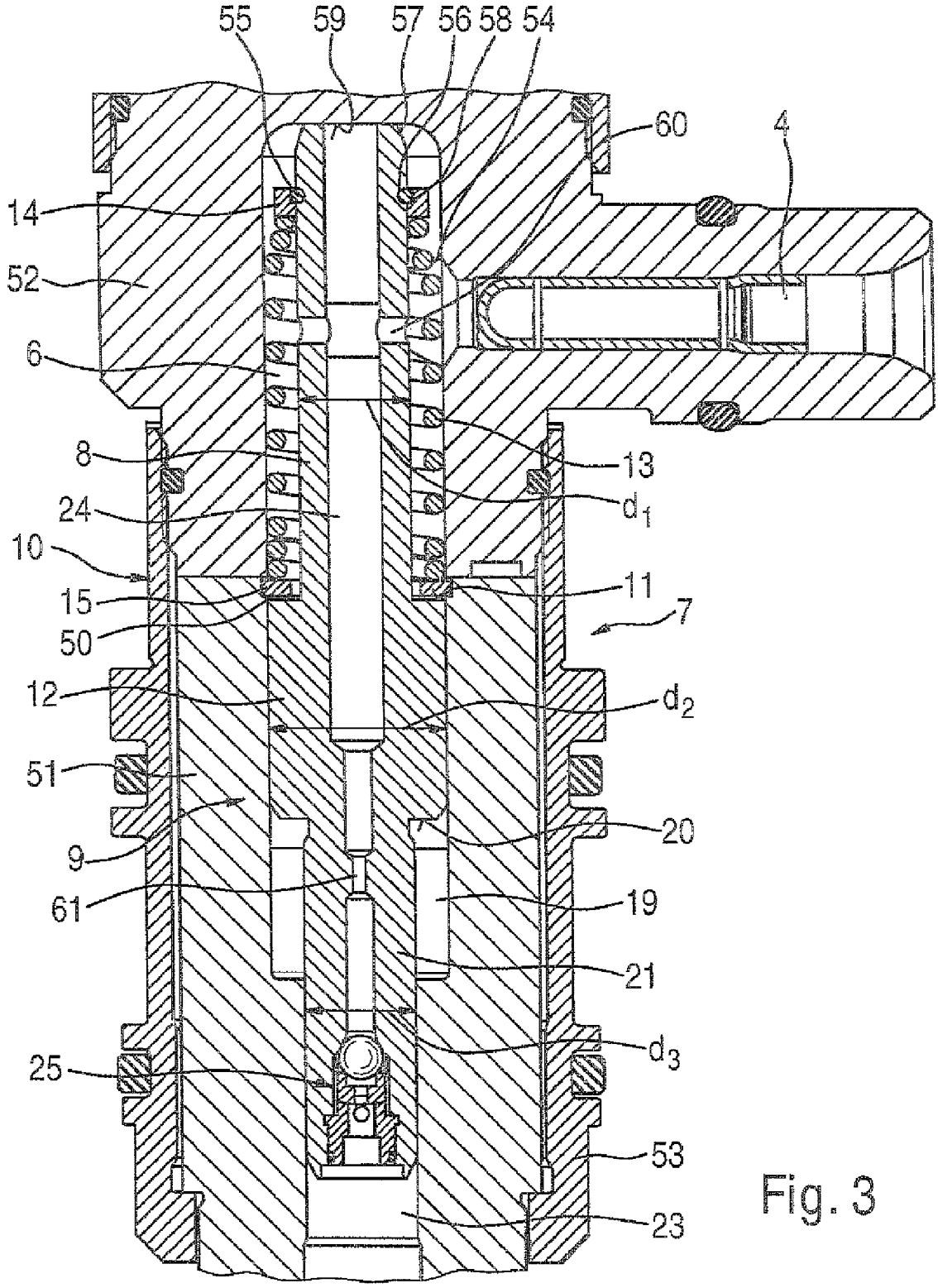
FIG. 3 is an enlarged depiction of the pressure booster piston according to FIG. 2.

FIG. 3 is an enlarged depiction of the pressure booster 7 of the fuel injector shown in FIG. 2.

FIG. 3 shows that one end of the spring element 13 is supported against the ring 15 and the other end is supported against the spring plate 14. The ring 15 rests against a shoulder 50 embodied on a middle housing section 51. The spring force of the spring element 13 is thus transmitted to the injector housing 10. The middle housing section 51 is connected to the upper housing section 52 by means of a retaining nut 53.

According to the invention, the spring element 13 has a conical section 54. This prevents the spring element 13 from rubbing against the upper section 8 of the pressure booster piston 9. So that the spring element 13 can function as a return spring for the pressure booster piston 9, it is preferably a spiral spring embodied in the form of a compression spring, one end of which acts on the injector housing 10 and the other end of which acts on the pressure booster piston 9. To achieve this, one end of the spring element 13 is placed against the injector housing 10 by means of the ring 15 and the shoulder 50 and the other end is placed against the upper section 8 of the pressure booster piston 9 by means of the spring plate 14. To hold the spring plate 14 in place on the upper section 8 of the pressure booster piston 9, the spring force of the spring element 13 presses it against a ring element 55. The ring element 55 is prevented from sliding on the upper section 8 of the pressure booster piston 9 by being accommodated in a groove 56 in the upper section 8 of the pressure booster piston 9. The ring element 55 is preferably a snap ring.

One advantage of installing the spring element 13 with the ring 15 and the spring plate 14 is that the pressure booster piston 9 can be preassembled together with the spring element 13. This also simplifies the subsequent installation in the fuel injector 5. For assembly, first the ring 15 is slid onto the upper section 8 of the pressure booster piston 9. To this end, the inner diameter of the ring 15 is selected so that it is larger than the diameter $d_1$ of the upper section 8 of the pressure booster piston 9 and smaller than the second diameter $d_2$ of the middle section 12 of the pressure booster piston 9. Because the second diameter $d_2$ of the middle section 12 is larger than the first diameter $d_1$ of the upper section 8 of the pressure booster piston 9, this forms the first shoulder 11 at the transition from the first section 8 to the middle section 12. Since the inner diameter of the ring 15 is smaller than the second diameter $d_2$ of the middle section 12 of the pressure booster piston 9, the ring 15 rests against the shoulder 11 when installed. Then, the spring element 13 is slid onto the upper section 8 of the pressure booster piston 9 until it rests against the ring 15. The conical region 54 of the spring element 13 is embodied so that the last coil of the spring element 13 has an inner diameter that corresponds to the first diameter $d_1$ of the upper section 8 of the pressure booster piston 9. This simultaneously centers the spring element 13 on the upper section 8. In the next assembly step, the spring plate 14 is slid onto the upper section 8 of the pressure booster piston 9. Lastly, the ring element 55 is installed. To facilitate installation of the ring element 55, a bevel 57 is provided on the upper section 8 of the pressure booster piston 9. The ring element 55 is preferably embodied to be expandable. This allows the ring element 55 to be slid onto the upper section 8 of the pressure booster piston 9 via the bevel 57. The ring element 55 expands as it travels along the bevel 57. As soon as the ring element 55 reaches the groove 56, it snaps into it. This secures the ring element 55 firmly to the upper section 8 of the pressure booster piston 9. From this point on, the spring force of the spring element 13 holds the spring plate 14 pressed against the ring element 55. To prevent the spring plate 14 from tilting in response to an uneven load exerted on it by the spring element 13, the spring plate is preferably provided with a cylindrical section 58 that encompasses the ring element 55. This achieves a firm seating of the spring plate 14.

The thus preassembled pressure booster piston 9 with the spring element 13 is then inserted into the middle housing part 51. So that the ring 15 rests against the shoulder 50 on the middle housing part 51, the outer diameter of the ring 15 is larger than the second diameter $d_2$ of the middle section of the pressure booster piston 9. If the pressure booster piston 9 is slid further into the middle housing part 51 after the ring 15 has come to rest against the shoulder 50, this prestresses the spring element 13. This prestressing serves to move the pressure booster piston 9 back into the control chamber 6 during operation. The movement of the pressure booster piston 9 finishes when it strikes against an end surface 59 that is embodied in the upper housing section 52 and delimits the control chamber 6. A lateral bore 60 that feeds into the conduit 24 is provided in the upper section 8 of the pressure booster piston 9 so that fuel can flow out of the control chamber 6 and into the compression chamber 23 even when the pressure booster piston 9 has come to rest against the end surface 59. Fuel at system pressure continuously travels into the conduit 24 via the lateral bore 60.

The conduit 24 also contains a throttle element 61. The throttle element 61 damps the fuel flow in the conduit 24, thus avoiding a pulsation of the check valve 25 and a resulting wear in the region of the check valve 25.

In order to be able to produce an injection pressure in the compression chamber 23 that is higher than the system pressure with which the fuel is supplied to the fuel injector 5, the lower section 21 of the pressure booster piston 9 is embodied with a third diameter $d_3$ that is smaller than the second diameter $d_2$. The injection pressure to which the fuel in the compression chamber 23 is compressed is thus a function of the ratio of the second diameter $d_2$ of the middle section 12 of the pressure booster piston 9 to the third diameter $d_3$ of its lower section 21.

The foregoing relates to the preferred exemplary embodiment of the invention, it being understood that other variants and embodiments thereof are possible within the spirit and scope of the invention, the latter being defined by the appended claims.

The invention claimed is:

1. A fuel injector for injecting fuel into a combustion chamber of an internal combustion engine, comprising:

an injection valve element for opening and closing at least one injection opening;

a pressure booster having a pressure booster piston with which fuel at system pressure is compressed to injection pressure;

a first control valve which triggers the pressure booster;

a second control valve which triggers the injection valve element; and a spring element, which is associated with the pressure booster piston, having one end supported on an injector housing and another end supported on the pressure booster piston, wherein the pressure booster piston delimits a compression chamber, a differential pressure chamber, and a control chamber, wherein the control chamber is situated at an end of the pressure booster piston and the compression chamber is situated at an end of the pressure booster opposite the control chamber, wherein the spring element is contained in the control chamber with one end of the spring element supported on the injector housing and the other end of the spring element supported on the pressure booster piston, wherein a spring plate against which the spring element rests is mounted on the pressure booster piston, and wherein the spring plate rests against a ring element that is accommodated in a groove in the pressure booster piston.

2. The fuel injector as recited in claim 1, wherein the spring element tapers conically at the end with which it is supported on the pressure booster piston.

3. The fuel injector as recited in claim 2, wherein the spring plate has a cylindrical shoulder that encompasses the ring element.

4. The fuel injector as recited in claim 2, wherein the pressure booster piston has an upper section that is embodied by a first diameter and is encompassed by the control chamber; a middle section that is embodied by a second diameter larger than the first diameter that delimits the control chamber with a first shoulder that delimits the differential pressure chamber with a second shoulder situated at an opposite end from the first shoulder; and a lower section that is embodied by a third diameter smaller than the second diameter that delimits the compression chamber.

5. The fuel injector as recited in claim 4, wherein the spring element is supported on a ring, which rests against a shoulder on the injector housing, and the ring has an inner diameter that is larger than the diameter of the upper section of the pressure booster piston and smaller than the diameter of its middle section.

6. The fuel injector as recited in claim 4, wherein the conical end of the spring element is embodied so that a last coil of the spring element has an inner diameter that corresponds to the first diameter of the upper section of the pressure booster piston.

7. The fuel injector as recited in claim 1, wherein the spring plate has a cylindrical shoulder that encompasses the ring element.

8. The fuel injector as recited in claim 7, wherein the pressure booster piston has an upper section that is embodied by a first diameter and is encompassed by the control chamber; a middle section that is embodied by a second diameter larger than the first diameter and that delimits the control chamber with a first shoulder, and that delimits the differential pressure chamber with a second shoulder situated at an opposite end from the first shoulder; and a lower section that is embodied by a third diameter smaller than the second diameter and that delimits the compression chamber.

9. The fuel injector as recited in claim 8, wherein the spring element is supported on a ring, which rests against a shoulder on the injector housing, and the ring has an inner diameter that is larger than the diameter of the upper section of the pressure booster piston and smaller than the diameter of its middle section.

10. The fuel injector as recited in claim 1, wherein the pressure booster piston has an upper section that is embodied by a first diameter and is encompassed by the control chamber; a middle section that is embodied by a second diameter larger than the first diameter that delimits the control chamber with a first shoulder and delimits the differential pressure chamber with a second shoulder situated at an opposite end from the first shoulder; and a lower section that is embodied by a third diameter smaller than the second diameter that delimits the compression chamber.

11. The fuel injector as recited in claim 10, wherein the spring element is supported on a ring, which rests against a shoulder on the injector housing, and the ring has an inner diameter that is larger than the diameter of the upper section of the pressure booster piston and smaller than the diameter of its middle section.

12. The fuel injector as recited in claim 10, wherein the pressure booster piston contains a conduit that hydraulically connects the control chamber to the compression chamber and the conduit contains a check valve that prevents a reverse flow of fuel from the compression chamber back into the control chamber.

13. The fuel injector as recited in claim 10, wherein the first control valve connects the differential pressure chamber to a fuel supply or to a fuel return.

14. The fuel injector as recited in claim 13, wherein the first control valve is a 3/2-way directional-control valve.

15. The fuel injector as recited in claim 10 wherein the ring element is expandable and the upper section of the pressure booster piston is provided with a bevel to facilitate installation of the ring element.

16. The fuel injector as recited in claim 1, wherein the pressure booster piston contains a conduit that hydraulically connects the control chamber to the compression chamber and the conduit contains a check valve that prevents a reverse flow of fuel from the compression chamber back into the control chamber.

17. The fuel injector as recited in claim 1, wherein the first control valve connects the differential pressure chamber to a fuel supply or to a fuel return.

18. The fuel injector as recited in claim 17, wherein the first control valve is a 3/2-way directional-control valve.

19. The fuel injector as recited in claim 17, wherein the first control valve is embodied as a solenoid valve having an armature that is connected to a valve slider that connects the differential pressure chamber to the fuel supply or to the fuel return.

20. The fuel injector as recited in claim 1, wherein the second control valve is embodied as a solenoid valve having an armature that is connected to a valve element which opens or closes a connection from an outlet line into a fuel return line.

* * * * *